US007588004B2

(12) United States Patent
Kohrs et al.

(10) Patent No.: US 7,588,004 B2
(45) Date of Patent: Sep. 15, 2009

(54) VANE-TYPE CAMSHAFT ADJUSTER

(75) Inventors: Mike Kohrs, Wilthen (DE); Hermann Golbach, Erlangen (DE)

(73) Assignee: Ina-Schaeffler, KG (DE)

( * ) Notice: Subject to any disclaimer, the term of this patent is extended or adjusted under 35 U.S.C. 154(b) by 281 days.

(21) Appl. No.: 11/570,321

(22) PCT Filed: May 10, 2005

(86) PCT No.: PCT/EP2005/005039

§ 371 (c)(1),
(2), (4) Date: Feb. 6, 2007

(87) PCT Pub. No.: WO2005/121511

PCT Pub. Date: Dec. 22, 2005

(65) Prior Publication Data

US 2008/0047390 A1 Feb. 28, 2008

(30) Foreign Application Priority Data

Jun. 8, 2004 (DE) ..... 10 2004 027 951

(51) Int. Cl.
*F01L 1/34* (2006.01)

(52) U.S. Cl. ..... 123/90.17; 123/90.15; 123/90.31

(58) Field of Classification Search ..... 123/90.15, 123/90.17, 90.31
See application file for complete search history.

(56) References Cited

U.S. PATENT DOCUMENTS

| | | | | |
|---|---|---|---|---|
| 6,192,844 | B1 | 2/2001 | Scheidt et al. | 123/90.17 |
| 6,374,787 | B2 * | 4/2002 | Simpson et al. | 123/90.17 |
| 2002/0038637 | A1 | 4/2002 | Kanada et al. | 123/90.15 |

FOREIGN PATENT DOCUMENTS

| | | | |
|---|---|---|---|
| DE | 198 44 646 | A1 | 5/1999 |
| DE | 199 62 981 | A1 | 7/2001 |
| DE | 102 28 832 | A1 | 1/2003 |
| EP | 1 479 877 | A2 | 11/2004 |

OTHER PUBLICATIONS

International Search Report PCT!EP2005/005039 dated Aug. 26, 2005.

* cited by examiner

*Primary Examiner*—Zelalem Eshete
(74) *Attorney, Agent, or Firm*—Ostrolenk Faber LLP

(57) ABSTRACT

Vane-cell camshaft adjuster with a stator and a rotor which is hydraulically rotatable relative to the stator. The rotor is connectable to a camshaft. It is provided with radially projecting vanes which are inserted in vane slots in the rotor. The axial end section of the vane slot on the camshaft side has an enlarged cross section.

12 Claims, 4 Drawing Sheets

( State of the art )

VANE-TYPE CAMSHAFT ADJUSTER

CROSS REFERENCE TO RELATED APPLICATION

The present application is a 35 U.S.C. §§ 371 national phase conversion of PCT/EP2005/005039, filed 10 May 2005, which claims priority of German Application No. 10 2004 027 951.9, filed 8 Jun. 2004. The PCT International Application was published in the German language.

FIELD OF THE INVENTION

The invention relates to a vane-cell camshaft adjuster with a stator and a rotor which is hydraulically rotatable relative to the stator, is connectable to a camshaft, and is provided with radially projecting vanes which are inserted in vane slots.

BACKGROUND OF THE INVENTION

Camshaft adjusters are used to change the timing for the opening or closing of the valves. The fixed angular relationship between the camshaft and the crankshaft which drives it is nullified as a result, and the timing can be optimally adjusted in dependence upon the speed and other parameters. Camshaft adjusters enable a relative rotation of the camshaft to the crankshaft.

Known vane-cell camshaft adjusters have a rotor with a plurality of radially projecting vanes which by the force of a spring are pressed radially outwards against a stator casing. A plurality of stops, which project radially inwards, are formed on the stator, which limit the adjusting movement of the rotor in both directions of rotation if the vanes run against the stops. The leading edges of the vanes lie on the stator so that between one vane side and the adjacent side of a stop of the stator, a chamber is formed in each case, into which a fluid, as a rule, the engine oil, is supplied through a valve which is allocated to the camshaft adjuster. The stator on one hand serves for separating and sealing of the fluid chambers and on the other hand for the fixing of the timing adjustment angle between the camshaft and the crankshaft.

The rotor of the camshaft adjuster during assembly is connected by a screw to the camshaft with frictional locking. For creation of the frictional locking, the rotor (rotary piston) of the adjuster, by the pretensioning force of the central screw, is pressed by its lateral flange face onto the corresponding side face of the camshaft. The frictional locking has to transmit from the drive the driving torque and possible axial or radial forces. As a result, a relatively high pretensioning force has to be introduced. However, it has been proved that in the rotor, on the side facing the camshaft, relatively high tensile stresses are created in the slot base of the vane slots. In addition, due to the transmission of the camshaft driving torque from the drive to the output of the adjuster, high tensile stresses are introduced in the vane slot as a result of the supporting of the vane in the vane slot. As a result, there takes place a superimposition of the forces and stresses and, as a consequence, a high stress of the material.

The use of materials with a higher strength, however, should be avoided, since materials of higher strength in most cases require expensive and costly manufacturing technologies. Also, the increasing of the width and/or the diameter of the rotor is no practical solution, since these measures lead to an increased weight and to increased inertia. The mere increasing of the radius in the slot base over the width of the rotor is not possible, since the secure guiding of the vane is then possibly no longer ensured. Furthermore, there is the risk that the vane spring, which is installed on the slot base of the vane slot, changes its position.

SUMMARY OF THE INVENTION

The invention is based, therefore, on the problem of disclosing a vane-cell camshaft adjuster, in which the stress concentration on the camshaft side is reduced.

For the solving of this problem in a vane-cell camshaft adjuster of the type mentioned at the beginning, it is provided, according to the invention, that the axial region end section of the vane slot on the camshaft side has an enlarged cross section.

The invention is based on the knowledge that the stresses in the region of the slot base of the vane slot, which arise as a result of the pretensioning force of the central screw, are limited in the axial direction of the rotor locally to the area of the flange face which in the installed state is adjacent to the camshaft. According to the invention, only this limited area is provided with a stress-optimized contour, while the remaining area of the vane slot maintains the conventional functional contour for optimum guiding of the vane and the vane spring. By means of the enlarged cross section in the region of the end section of the vane slot on the camshaft side, the notch effect is reduced, and there occurs a more uniform distribution of stress over the width, with substantially reduced stress peaks.

An especially effective reduction of the stress peaks can be achieved if the vane slot, in the region of the slot base, is undercut with regard to the side faces of the slot, and has an enlarged cross section at this point. According to the invention, therefore, especially the area which is at most risk, which is located on the undercut, is relieved by the choice of an increased cross section. The remaining area, which is at a distance from the locating face of the rotor on the camshaft side, remains unaltered. The enlarged area on one hand can be located in the region of the slot base. However, it can also be provided in the region of the undercut. Furthermore, the region with enlarged cross section can be provided both in the region of the slot base and also in the region of the undercut.

An especially favorable diffusion of stress results if the transition between the cross section of the slot which is not enlarged and the cross section which is enlarged, is formed in an arc shape. The transition between the two cross sections with different diameter, which is formed as an arc, brings about a gradual increase of stress so that local stress peaks are avoided.

According to an alternative development of the invention, it can be provided that the vane slot in the region of the undercut and the slot base has a section with an enlarged cross section, which extends radially outwards. In this variant, that area which extends radially outwards from the slot base is optimized. The original slot base and the slot base in the end section in this case can have a common base line. The cross section of the enlarged area can be formed approximately oval, and in the region of the slot base can have a straight section. It is also possible that the enlarged section has at least approximately a constant diameter. Such a construction is especially favorable to manufacture.

According to a further alternative development of the invention, it can also be provided that the section of the vane slot, the cross section of which is not enlarged, merges into a section with continuously increasing cross section. The vane slot in this case can be left unaltered in the region of the slot base, while from there it widens outwards in a radial direction like a cup. Also in this embodiment, an oval cross section of the enlarged area is preferred. As a result of the continuous transition between the vane slot with the normal cross section and the section with the enlarged cross section, increased stress concentrations on the side face, upon which lies the camshaft, are avoided. Consequently, it is not necessary to resort to a material with an increased strength, and the subject of the invention can be inexpensively manufactured.

According to a further, also especially advantageous development of the invention, it can be provided that the vane slot in the region of the slot base has a section with an enlarged cross section, which extends radially inwards. This area with the increased cross section is provided preferably in addition to the section with the increased cross section which is located in the region of the undercut and in the slot base and which extends radially outwards. Overall, the whole area which encompasses the undercut, the slot base and the start of the side faces of the slot, can have an increased diameter. Since sharp-edged transitions are formed at no point, no local stress peaks occur. The area with the enlarged cross section has an oval basic shape and is formed like a cone.

BRIEF DESCRIPTION OF THE DRAWINGS

Further advantages and details of the invention are explained on the basis of preferred exemplary embodiments with reference to the figures. The figures are schematic views in which.

DETAILED DESCRIPTION OF THE DRAWINGS

Figure 1:
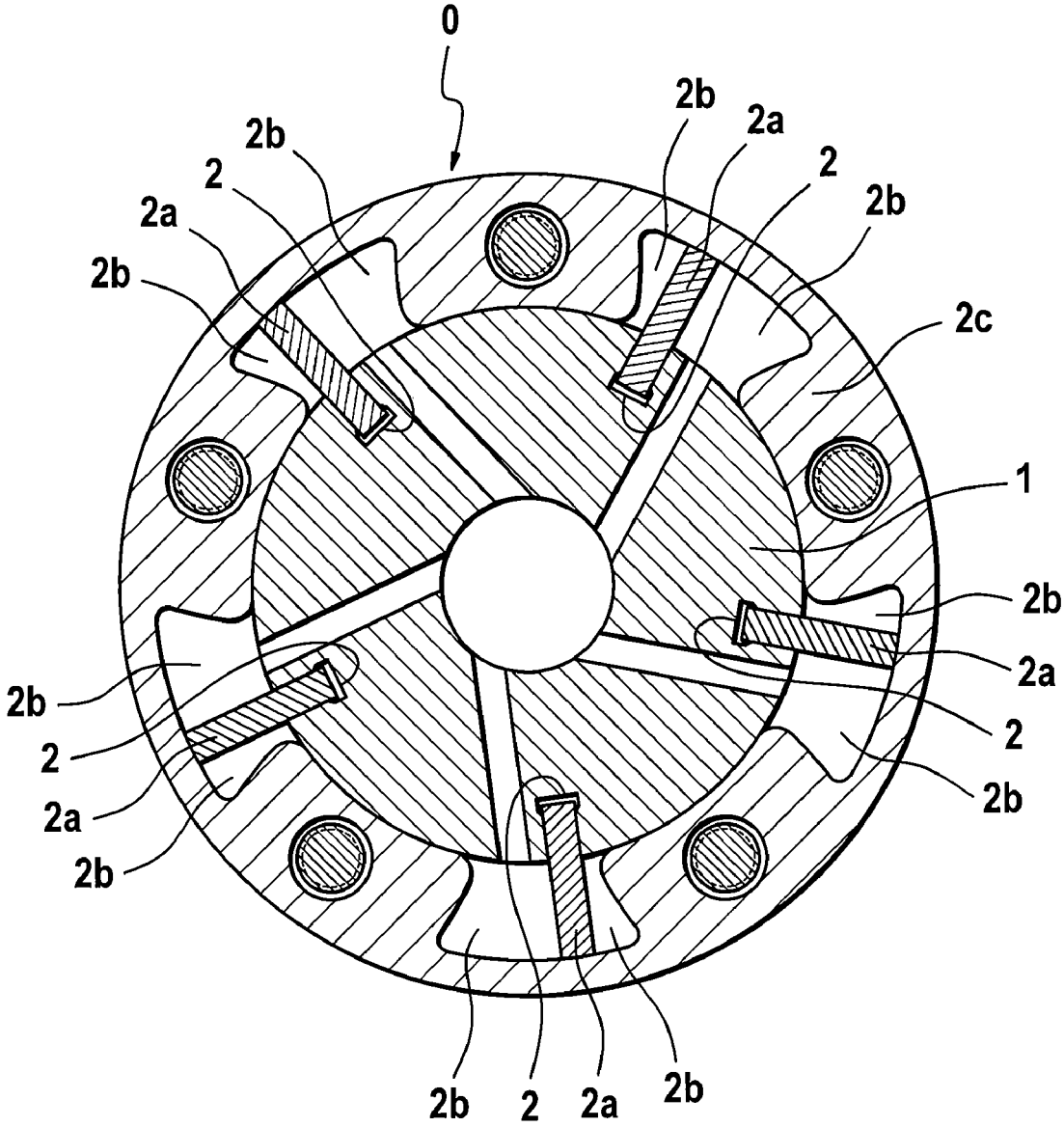
FIG. 1 shows a cross section through a vane-cell camshaft adjuster.
Figure 2A:
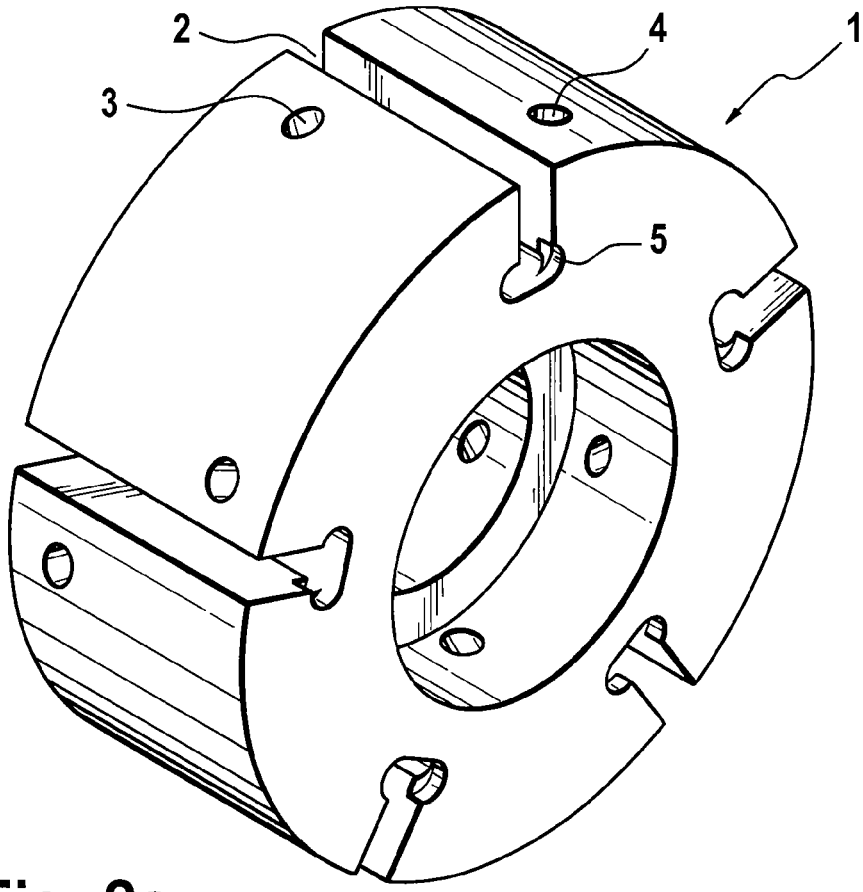
FIG. 2*a* shows a perspective view of the rotor of a vane-cell camshaft adjuster according to the invention.

FIG. 1 shows cross section through a vane-cell camshaft adjuster 0, FIG. 2*a* shows a perspective view of a rotor 1 of a vane-cell camshaft adjuster 0.

The rotor 1 has a disc-form basic shape and has five vane slots 2 distributed equally over the circumference, in which vanes 2*a* are insertable, which are sealed by oil-fillable chambers 2*b* between the rotor 1 and a stator 2*c*. Holes 3, 4 are located on the left hand and right hand side of each vane slot 2, through which the oil can flow into the aforementioned chambers 2*b* and flow out again.

The vane slot 2 extends in the axial direction and has an enlarged cross section at its axial end section 5.

Figure 2B:
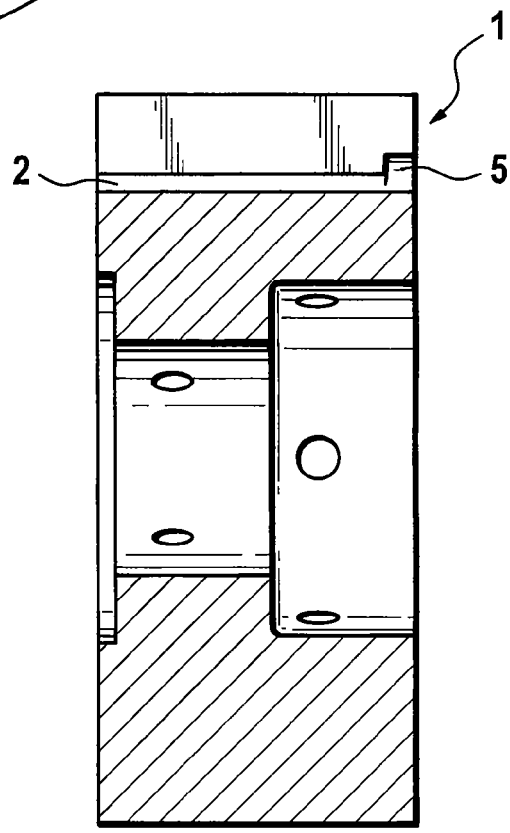
FIG. 2*b* shows a side view of the rotor which is shown in FIG. 1.

FIG. 2*b* shows a sectioned side view of the rotor 1 which is shown in FIG. 1. In this view, it is seen that the vane slot 2 has a constant cross section in the axial direction approximately over the whole thickness of the rotor 1, and has an enlarged cross section only in the axial region of the axial end section 5. This cross-sectional enlargement leads to a reduction of the notch effect and, therefore, to lower stress peaks in the region of the end section 5.

Figure 3A:
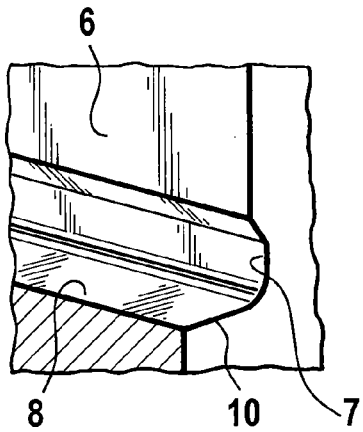
FIG. 3*a-c* show views of the end section of the vane slot of a rotor according to the prior art.
Figure 3B:
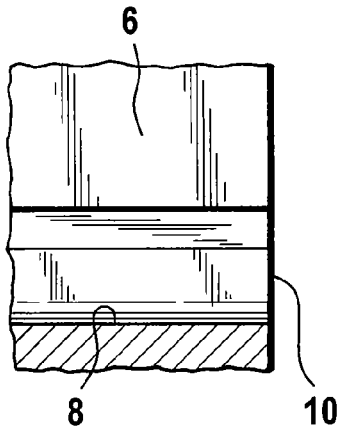
Figure 3C:
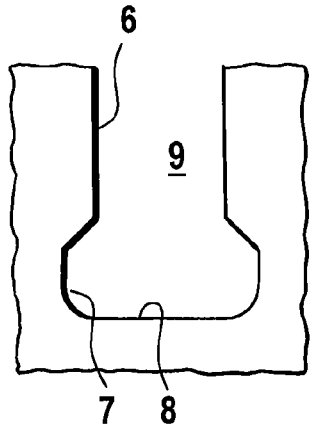

FIGS. 3*a-c* are enlarged views of the end section of the vane slot 9 of a rotor according to the prior art. FIG. 3*a* is a perspective view of the vane slot 9, FIG. 3*b* is a side view of the vane slot 9, similar to FIG. 2, FIG. 3*c* is a front view of the vane slot 9. As is to be seen in FIG. 3*c*, the side faces 6 of the slot have an undercut 7 in the region of the slot base 8, which consists of arc-shaped pieces and straight pieces. The vane slot 9 has the same constant diameter on the free end 10 as in the remaining area so that at this point there is a relatively sharper cross sectional jump which causes the increased stresses.

Figure 4A:
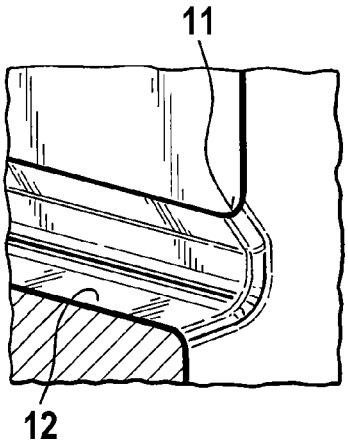
FIG. 4*a-c* show a first exemplary embodiment of the invention.
Figure 4B:
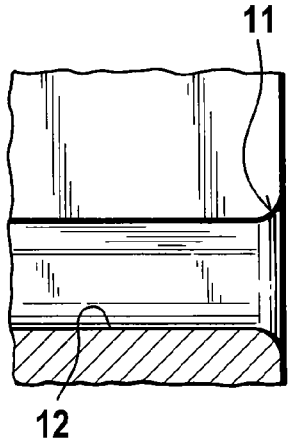
Figure 4C:
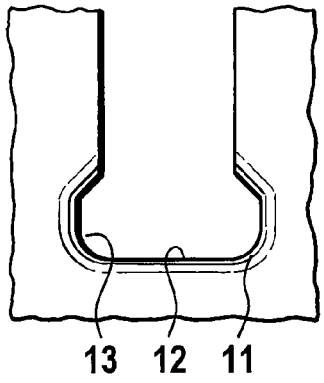

FIGS. 4*a-c* show a first exemplary embodiment of the invention.

Other than in the vane slot which is shown in FIGS. 3*a-c*, the transition 11 between the cross section of the slot which is not enlarged and the cross section of the axial end section which is enlarged, is formed in the shape of an arc. The transition 11 in this case extends outwards both from the slot base 12 and also from the undercuts 13. The arc-shaped transition 11 effects a comparatively gentle force deflection which in addition to the increased cross section on the outer side leads to lower stress concentrations.

Figure 5A:
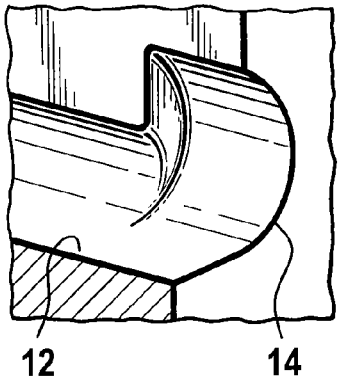
FIG. 5*a-c* show a second exemplary embodiment of the invention.
Figure 5B:
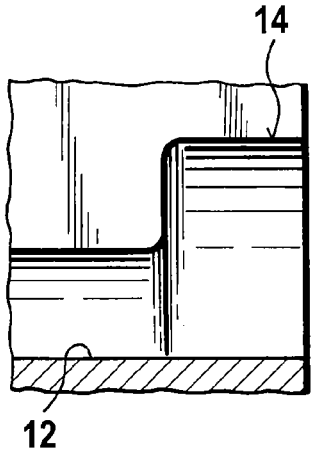
Figure 5C:
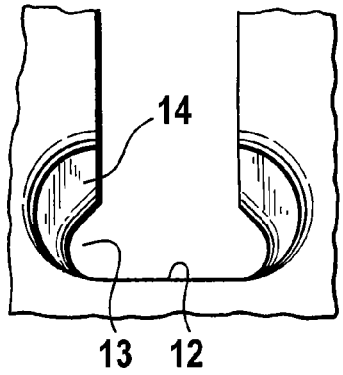

FIGS. 5*a-c* show a second exemplary embodiment of the invention. The vane slot, in the region of the undercut 13, has a section 14 with an increased diameter, which extends radially outwards, that is to say, towards the opening of the vane slot. As is to be best seen in FIG. 5*b*, the diameter of the section 14 is constant. On the other hand, the area with the enlarged cross section does not extend radially inwards from the slot base 12. The desired stress reduction in this variant is achieved above all by the increased diameter.

Figure 6A:
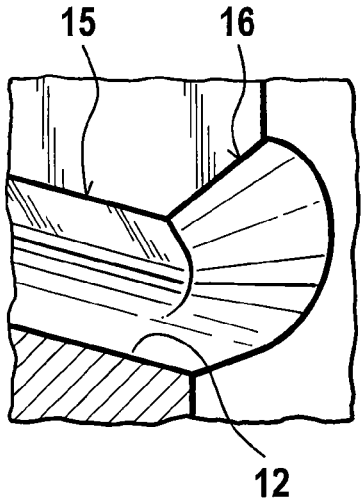
FIG. 6*a-c* show a third exemplary embodiment of the invention.
Figure 6B:
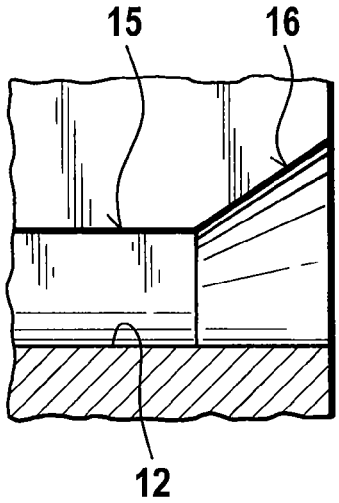
Figure 6C:
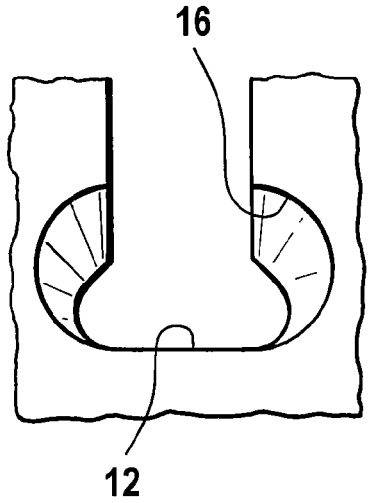

The FIGS. 6*a-c* show a third exemplary embodiment of the invention.

In FIG. 6*b*, it is discernible that the cross section of the section 15 of the vane slot which is not enlarged merges into a section 16 with continuously increasing cross section. This variant is also characterized by an especially low level of the local peak stresses. In accordance with the variant according to FIGS. 5*a-c*, the area which extends radially inwards from the slot base 12 has no enlarged cross section.

Figure 7A:
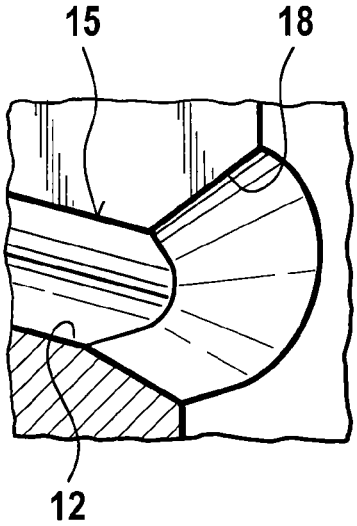
FIG. 7*a-c* show a fourth exemplary embodiment of the invention.
Figure 7B:
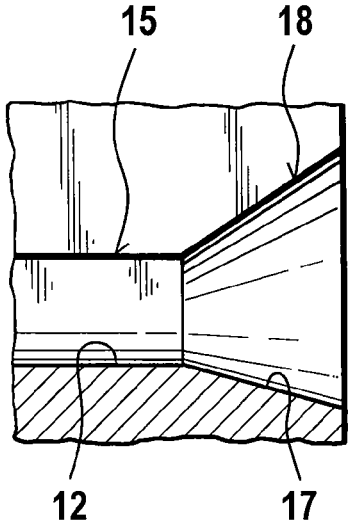
Figure 7C:
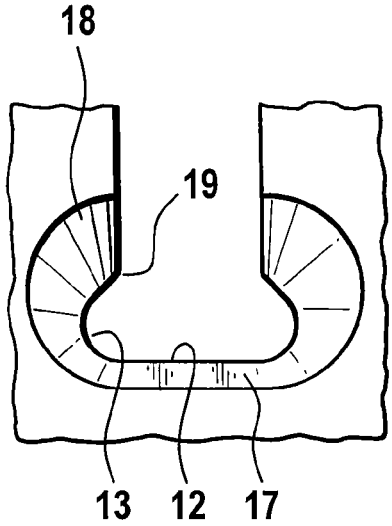

FIG. 7*a-c* show a fourth exemplary embodiment of the invention. The basic construction of this end section of the rotor 1 resembles that which is shown in FIGS. 6*a-c*, the vane slot in the region of the slot base 12 additionally has a section 17 with an enlarged cross section, which extends radially inwards. The enlarged section 18, which extends on both sides of the undercuts 13, is constructed as shown in FIGS. 6*a-c*, it corresponds, therefore, to the section 16 from FIG. 6. The opening formed on the side face of the rotor 1, which consists of the boundaries of the sections 17, 18, is formed approximately oval, seen from the flat slot base. The edge lines of the section 18 are arc sections of a circle, the middle point of which is located approximately in the region of the lower end 19 of the side faces of the slot.

The invention claimed is:

1. A vane-cell camshaft adjuster comprising:

a stator; and a rotor rotatably supported in the stator, the rotor being hydraulically rotatable relative to the stator, the rotor being connectable to a camshaft;

the rotor having a radial exterior; a plurality of vane slots extending into the rotor from the rotor exterior;

a respective radially projecting vane being supported in each of the vane slots;

an end section of the vane slot being located toward a camshaft side of the rotor; the end section of the vane slot having an enlarged cross section with respect to a cross section of the vane slot at an axial distance away from the end section, the axial distance being measured through at least a portion of the thickness of the rotor.

2. The vane-cell camshaft adjuster as claimed in claim 1, wherein the vane slot includes a radially inward slot base in the rotor, and the vane slot also has side faces at sides of the slot base;

at a region of the slot base in the end section, the vane slot has an undercut outward of side faces of the vane slot and with respect to the cross section of the vane slot at the axial distance away from the end section.

3. The vane-cell camshaft adjuster as claimed in claim 2, wherein in the region of the slot base in the end section, the vane slot has an enlarged cross section with respect to a cross section of the slot base of the vane slot at the axial distance away from the end section.

4. The vane-cell camshaft adjuster as claimed in claim 2, wherein in the region of the undercut, the vane slot has an enlarged cross section with respect to a cross section of the undercut of the vane slot at the axial distance away from the end section.

5. The vane-cell camshaft adjuster as claimed in claim 1, further comprising an arc-shaped transition in the vane slot between the cross section of a section of the vane slot at the axial distance away from the end section which is not an enlarged cross-section and the cross section of the vane slot at the end section which is an enlarged cross-section.

6. The vane-cell camshaft adjuster as claimed in claim 3, wherein in the region of the undercut and of the slot base in the end section, the vane slot has an enlarged cross section which extends radially outwards.

7. The vane-cell camshaft adjuster as claimed in claim 6, wherein the end section of the vane slot with the enlarged cross section has at least approximately a constant cross section along its axial length.

8. The vane-cell camshaft adjuster as claimed in claim 6, wherein a section of the vane slot, at the axial distance away from the end section and having a cross section which is not enlarged, merges into the end section of the vane slot which has a continuously increasing cross section in a direction toward the camshaft side of the rotor, the direction being parallel to the axial distance.

9. The vane-cell camshaft adjuster as claimed in claim 6, wherein in the end section of the vane slot in the region of the slot base, the vane slot has a section with an enlarged cross section and which extends radially inwards.

10. The vane-cell camshaft adjuster as claimed in claim 9, wherein a section of the vane slot, at the axial distance away from the end section and having a cross section which is not enlarged, merges into the end section of the vane slot which has a continuously increasing cross section in a direction toward the camshaft side of the rotor, the direction being parallel to the axial distance.

11. The vane-cell camshaft adjuster as claimed in claim 3, wherein in the region of the undercut, the vane slot has an enlarged cross section with respect to a cross section of the vane slot at the axial distance away from the end section.

12. The vane-cell camshaft adjuster as claimed in claim 2, wherein in the region of the undercut and of the slot base in the end section, the vane slot has an enlarged cross section which extends radially outwards.

* * * * *